US008686825B2

(12) United States Patent
Johnson et al.

(10) Patent No.: US 8,686,825 B2
(45) Date of Patent: Apr. 1, 2014

(54) OXIDATIVE OPENING SWITCH ASSEMBLY AND METHODS

(75) Inventors: Richard F. Johnson, Sacramento, CA (US); Randy Berg, Coon Rapids, MN (US); Stanley E. Wood, Tuscon, AZ (US)

(73) Assignee: JPA, Inc., Crystal, MN (US)

( * ) Notice: Subject to any disclaimer, the term of this patent is extended or adjusted under 35 U.S.C. 154(b) by 145 days.

(21) Appl. No.: 13/178,783

(22) Filed: Jul. 8, 2011

(65) Prior Publication Data

US 2011/0266118 A1 Nov. 3, 2011

Related U.S. Application Data

(63) Continuation of application No. 12/142,983, filed on Jun. 20, 2008, now Pat. No. 7,994,892.

(60) Provisional application No. 60/945,460, filed on Jun. 21, 2007.

(51) Int. Cl.

| | |
|---|---|
| ***H01H 37/76*** | (2006.01) |
| ***H01H 85/04*** | (2006.01) |
| ***H01H 35/24*** | (2006.01) |

(52) U.S. Cl.

USPC ..... 337/296; 337/416; 337/159; 337/163; 200/61.03; 200/61.08

(58) Field of Classification Search

USPC ..... 337/296, 416, 159, 163; 200/61.03, 200/61.08

See application file for complete search history.

(56) References Cited

U.S. PATENT DOCUMENTS

| | | | | | |
|---|---|---|---|---|---|
| 3,357,911 | A | * | 12/1967 | Gruner et al. | 204/411 |
| 3,544,852 | A | * | 12/1970 | Giles | 361/501 |
| 3,544,853 | A | * | 12/1970 | Giles | 361/501 |
| 3,753,110 | A | * | 8/1973 | Ikeda et al. | 368/114 |
| 3,768,015 | A | * | 10/1973 | Moser | 368/114 |
| 4,084,511 | A | * | 4/1978 | Svrjcek, Jr. | 102/277 |
| 4,103,296 | A | * | 7/1978 | Hart et al. | 340/309.7 |
| 4,196,060 | A | * | 4/1980 | Patrie et al. | 205/50 |
| 4,220,087 | A | * | 9/1980 | Posson | 102/275.6 |
| 4,291,255 | A | * | 9/1981 | Alexeff | 315/340 |
| 4,339,638 | A | * | 7/1982 | Lascelles et al. | 200/52 R |
| 4,406,952 | A | * | 9/1983 | Molen et al. | 307/104 |
| 4,571,468 | A | * | 2/1986 | Weldon | 200/61.08 |
| 4,598,338 | A | * | 7/1986 | Van Devender et al. | 361/435 |

(Continued)

OTHER PUBLICATIONS

Friedman, M et al., "Chemically enhanced opening switch for generating high-voltage pulses", Review of Scientific Instruments Mar. 1977, vol. 48, No. 3, pp. 279-281.

(Continued)

*Primary Examiner* — Bradley Thomas

(74) *Attorney, Agent, or Firm* — Pauly, Devries Smith & Deffner, LLC.

(57) ABSTRACT

Embodiments of the invention are related to oxidative opening switches and related methods, amongst other things. In an embodiment, the invention includes a switch assembly including a first terminal, a second terminal, and an oxidative switch element in electrical communication with the first terminal and the second terminal, the switch element comprising a conductive material and an oxidizer, the switch element configured to interrupt electrical communication between the first terminal and the second terminal as a result of an oxidation reaction between the conductive material and the oxidizer. In an embodiment, the invention includes a fast opening switch for pulse power applications. Other aspects and embodiments are provided herein.

21 Claims, 7 Drawing Sheets

(56) References Cited

U.S. PATENT DOCUMENTS

| | | | | |
|---|---|---|---|---|
| 4,727,298 | A * | 2/1988 | Mendel | 315/340 |
| 4,812,715 | A * | 3/1989 | Mendel | 315/340 |
| 4,860,269 | A * | 8/1989 | Hennings et al. | 368/107 |
| 4,918,325 | A * | 4/1990 | Busby et al. | 307/106 |
| 5,019,752 | A * | 5/1991 | Schumacher | 315/344 |
| 5,075,594 | A * | 12/1991 | Schumacher et al. | 315/111.21 |
| 5,132,597 | A * | 7/1992 | Goebel et al. | 315/344 |
| 5,329,205 | A * | 7/1994 | Goebel et al. | 315/111.21 |
| 5,336,975 | A * | 8/1994 | Goebel et al. | 315/111.41 |
| 5,558,718 | A * | 9/1996 | Leung | 118/723 E |
| 5,608,297 | A * | 3/1997 | Goebel | 315/344 |
| 5,828,176 | A * | 10/1998 | Goebel | 315/111.41 |
| 5,859,383 | A * | 1/1999 | Davison et al. | 102/307 |
| 5,917,286 | A * | 6/1999 | Scholl et al. | 315/111.21 |
| 6,198,701 | B1 * | 3/2001 | De Jonghe et al. | 368/327 |
| 6,222,321 | B1 * | 4/2001 | Scholl et al. | 315/111.21 |
| 6,304,042 | B1 * | 10/2001 | Savage et al. | 315/340 |
| 6,396,147 | B1 * | 5/2002 | Adachi et al. | 257/758 |
| 6,570,202 | B2 * | 5/2003 | Cuchiaro et al. | 257/295 |
| 6,888,268 | B1 * | 5/2005 | Stallings | 307/126 |
| 6,903,649 | B2 * | 6/2005 | Ackermann | 337/296 |
| 7,425,720 | B2 * | 9/2008 | Kaeriyama et al. | 257/4 |
| 7,626,893 | B2 * | 12/2009 | Robinson et al. | 368/114 |
| 7,634,042 | B2 * | 12/2009 | Auchterlonie | 376/141 |
| 7,812,704 | B2 * | 10/2010 | Darr et al. | 337/243 |
| 7,863,087 | B1 * | 1/2011 | Kumar et al. | 438/104 |
| 7,932,805 | B2 * | 4/2011 | Darr et al. | 337/243 |
| 7,994,892 | B2 | 8/2011 | Johnson et al. | |
| 2001/0019300 | A1 * | 9/2001 | Kaltenborn et al. | 337/155 |
| 2003/0112117 | A1 * | 6/2003 | Miyashita et al. | 337/407 |
| 2004/0211989 | A1 * | 10/2004 | Armgarth et al. | 257/253 |
| 2005/0045919 | A1 * | 3/2005 | Kaeriyama et al. | 257/211 |
| 2005/0263379 | A1 * | 12/2005 | Lindsey | 200/182 |
| 2006/0109075 | A1 * | 5/2006 | Cabal et al. | 337/333 |
| 2006/0261676 | A1 * | 11/2006 | Robinson et al. | 307/65 |
| 2007/0218687 | A1 * | 9/2007 | Sugawara et al. | 438/680 |
| 2008/0237499 | A1 * | 10/2008 | Auchterlonie | 250/503.1 |
| 2008/0259515 | A1 * | 10/2008 | Turpin et al. | 361/98 |
| 2009/0004884 | A1 * | 1/2009 | Nagamine et al. | 438/771 |
| 2010/0090539 | A1 * | 4/2010 | Auchterlonie | 307/106 |

OTHER PUBLICATIONS

Novac, B. M. et al., "Simple high-performance exploding wire opening switch", Pulsed Power Conference, 2007 16th IEEE International Jun. 17-22, 2007, vol. 2, pp. 1004-1007.

* cited by examiner

OXIDATIVE OPENING SWITCH ASSEMBLY AND METHODS

This application is a continuation of U.S. Utility patent application Ser. No. 12/142,983, filed Jun. 20, 2008, which claims the benefit of U.S. Provisional Patent Application No. 60/945,460, filed Jun. 21, 2007, the content of both of which are herein incorporated by reference in their entirety.

TECHNICAL FIELD

This disclosure relates generally to oxidative opening switches and related methods, amongst other things.

BACKGROUND OF THE INVENTION

Opening switches are components of electrical systems designed to open a circuit as is functionally desired. One common type of opening switch is a plasma opening switch (POS). In general, opening switches start out closed, shorting a transmission line carrying power from a power source, such as a homopolar generator. The opening switch causes energy to be stored in the circuit, such as inductively or capacitively, at a higher energy density than in the power source. After a certain time, depending on the parameters of the particular opening switch, resistance increases sharply (the switch opens), allowing the stored energy to flow to a load as a pulse of energy. By releasing the stored energy over a very short interval (a process that is called pulse compression), a huge amount of peak power can be delivered to a load. As such, the use of an opening switch between a generator and a load results in improving the rise-time of the load voltage and current, and in voltage and power multiplication.

Opening switches have many different pulsed power applications. For example opening switches can be used in light ion beam inertial confinement fusion experiments, electron beam diodes, Z-pinches, radiation generators, and other pulsed power devices.

However, many known types of opening switches have various practical or functional issues. By way of example, in radiation simulation systems plasma opening switches are generally large arrays of devices that require expensive and complex plasma generators.

SUMMARY OF THE INVENTION

Embodiments of the invention are related to oxidative opening switches and related methods, amongst other things. In an embodiment, the invention includes a switch assembly including a first terminal, a second terminal, and an oxidative switch element in electrical communication with the first terminal and the second terminal, the switch element comprising a conductive material and an oxidizer, the switch element configured to interrupt electrical communication between the first terminal and the second terminal as a result of an oxidation reaction between the conductive material and the oxidizer.

In an embodiment, the invention includes a fast opening switch for pulse power applications including a pair of conductors, and a switch element disposed between the conductors, the switch element comprising a conductive material and an oxidizer, the conductive material configured to increase its electrical resistivity by at least an order of magnitude over a period of time no longer than about 100 milliseconds in response to Joule heating of the switch element.

In an embodiment, the invention includes a pulse forming network including a power source, an output load, a closing switch in electrical communication with the output load, and an oxidative opening switch connected in parallel electrical communication with the output load; the oxidative opening switch including a first terminal, a second terminal, and a switch element in electrical communication with the first terminal and the second terminal, the switch element including a conductive material and an oxidizer, the pulse forming network configured to deliver an electrical pulse to the output load when the closing switch closes and the opening switch opens.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

BRIEF DESCRIPTION OF THE DRAWINGS

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

Embodiments of the invention include opening switches and opening switch assemblies that rely on an oxidation reaction for their function. In various embodiments, such oxidative opening switches and opening switch assemblies can function to open rapidly so that they can be usefully applied in conjunction with pulse forming networks and/or pulsed power applications.

Many oxidation reactions result in the formation of a gas as a reaction product. However, it has been found that the production of gases can be detrimental to the application of oxidative opening switches in some contexts. That is because the rapid generation of a significant amount of gas could potentially lead to potential voltage breakdown of the evolved gases or structural failure of the switch assembly itself and/or systems into which the switch assembly is included. As such, in various embodiments, an opening switch is included that has a conductor and an oxidizer selected to react without forming substantial amounts of gas.

Many oxidation reactions also generate a substantial amount of heat which may result in rapid pressure changes. However, it has been found that rapid temperature changes may lead to potentially damaging pressure waves. As such, in various embodiments, an opening switch is included that has a conductor and an oxidizer selected so that the enthalpy change associated with the oxidation reaction is relatively low.

Figure 1:
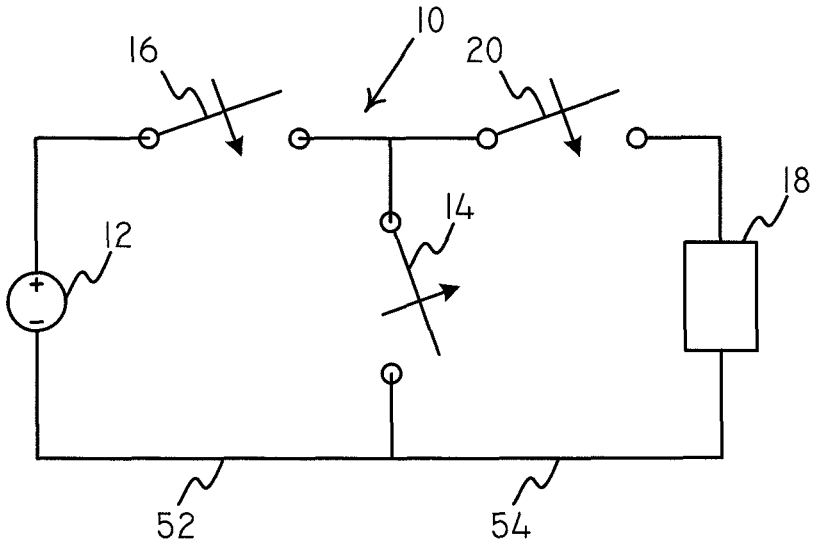
FIG. 1 is a schematic diagram of an exemplary pulsed power circuit in accordance with an embodiment of the invention.

Various aspects of oxidative opening switches and opening switch assemblies will now be described with reference to the Figures. Referring now to FIG. 1, a schematic diagram of an exemplary pulsed power circuit 10 is shown in accordance with an embodiment of the invention. The circuit 10 includes a power source 12. The power source 12 can include a variety of different component types including a homopolar generator with an output inductor, a pulsed alternator, a capacitor bank, or a battery, amongst others. The power source 12 is in communication with an oxidative opening switch element 14. Aspects of exemplary oxidative opening switches are described in greater detail below. The circuit can also include a first closing switch 16. In some embodiments, first closing switch 16 can be a spark gap, a vacuum spark gap or a vacuum flashover switch. The circuit can also include a load 18. Load 18 can include any type of load that utilizes a pulse of electrical current for its operation. For example, in some embodiments, load 18 can include equipment related to electron beam diodes, Z-pinches, and radiation sources. Optionally, the power source 12 is also in electrical communication with a second closing switch 20. In some embodiments, second closing switch 20 can be a spark gap or a vacuum spark gap.

In operation, when first closing switch 16 is closed, current can flow through a first path 52 (or charging path) including the power source 12, first closing switch 16, and oxidative opening switch element 14. As this happens, Joule heating takes place raising the temperature of components in oxidative opening switch element 14. The Joule heating acts to initiate an oxidation reaction within the oxidative opening switch element 14. As a conductive material within the oxidative opening switch element 14 is depleted chemically (converted in a redox reaction to a poorer conductor of electricity) the overall resistance of the oxidative opening switch element 14 will rapidly increase to the point where current passing through the opening switch element 14 will rapidly decrease. As this happens, an inductive spike in voltage will occur sufficient to cause second closing switch 20 to close, such as by current arcing across a spark gap. In this moment, a pulse of current can flow through a second path 54 (or load path) including the power source 12, first closing switch 16, second closing switch 20 and load 18.

Figure 2:
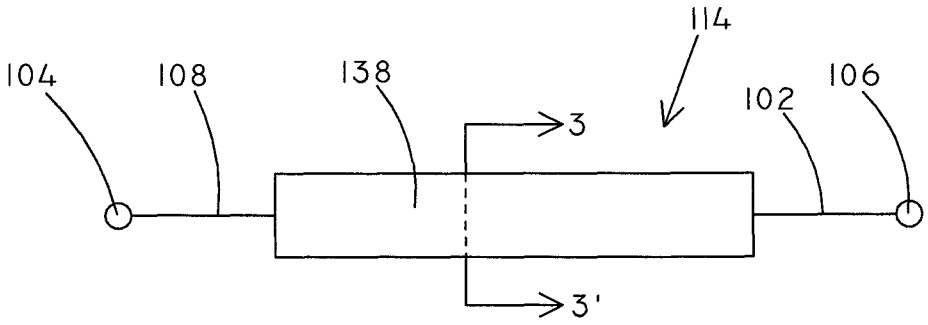
FIG. 2 is a schematic view of an oxidative opening switch assembly in accordance with an embodiment of the invention.

Referring now to FIG. 2, a schematic view of an oxidative opening switch assembly 114 is shown in accordance with an embodiment of the invention. The oxidative opening switch assembly 114 includes a first terminal 104 and a second terminal 106. The switch assembly 114 also includes an opening switch element 138 in electrical communication with the first terminal 104 and the second terminal 106 via a first conductor 108 and a second conductor 102 respectively.

Figure 3:
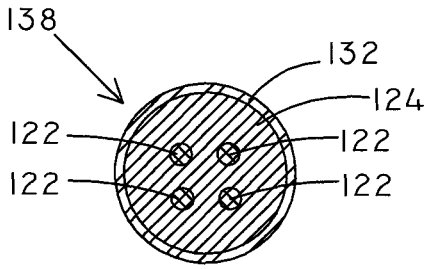
FIG. 3 is a cross-sectional view of an oxidative opening switch assembly as taken along line 3-3' of FIG. 2.

Referring now to FIG. 3, a cross-sectional view of the oxidative opening switch assembly of FIG. 2 is shown as taken along line 3-3'. The switch element 138 includes a case 132, one or more conductors 122, and an oxidizer 124. In some embodiments, the case 132 is made from a dielectric material. The conductor(s) can take on various shapes in cross-section. In some embodiments, the conductor is in substantially circular shape, such as in the context of a wire. In some embodiments, the conductor is in a substantially rectangular shape, such as in the context of a foil. The oxidizer 124 can be disposed on and surround the surface of the one or more conductors 122. Further aspects of exemplary opening switch elements are described in greater detail below.

When the oxidative opening switch assembly of FIGS. 2 and 3 is connected into a pulsed power circuit and the circuit is activated, electrical current passes through the opening switch element 138 between the first terminal 104 and the second terminal 106. As this happens, Joule heating takes place raising the temperature of components of the opening switch element 138. The Joule heating acts to trigger the oxidation reaction between the conductor(s) 122 and the oxidizer 124. This leads to the conductor(s) 122 and the oxidizer 124 forming reaction products that are much poorer conductors of electricity, effectively causing the opening switch element 138 to open. Specifically, as the conductor is depleted chemically (chemically converted in a redox reaction to a poor conductor of electricity) the overall resistance of current through the opening switch element 138 will rapidly increase to the point where current through the opening switch element 138 will rapidly decrease.

Figure 4:
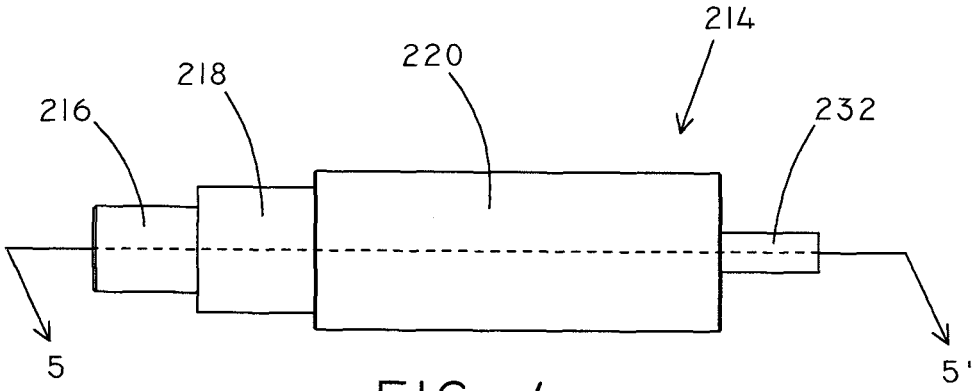
FIG. 4 is a schematic view of an oxidative opening switch assembly in accordance with another embodiment of the invention.
Figure 5:
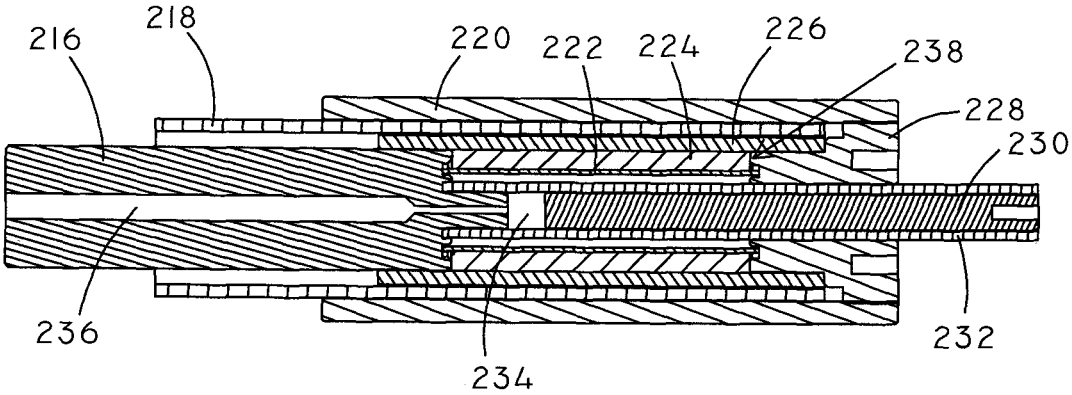
FIG. 5 is a cross-sectional view of an oxidative opening switch assembly as taken along line 5-5' of FIG. 4.

In various embodiments, an oxidative opening switch assembly can include both an oxidative opening switch element and a closing switch element. Referring now to FIG. 4, an oxidative opening switch assembly 214 is shown in accordance with another embodiment of the invention. FIG. 5 shows a cross-sectional view of the oxidative opening switch assembly 214 as taken along line 5-5' of FIG. 4. The oxidative opening switch assembly 214 includes center electrode 216, generator electrode 228, and load electrode 230. Initially, center electrode 216 is in electrical communication with generator electrode 228 via the oxidative opening switch element 238. The oxidative switch element 238 includes conductor 222 and oxidizer 224. Initially, center electrode 216 is not in electrical communication with load electrode 230. Specifically, center electrode 216 is separated from load electrode 230 by gap 234. The gap 234 can serve as part of a closing switch element. In this embodiment, the closing switch element is effectively coaxial with the oxidative opening switch element 238. The oxidative opening switch assembly 214 can also include one or more insulating elements such as 218, 220, 226, and 232.

When current initially flows through the switch assembly 214, it passes through center electrode 216, through oxidative switch element 238, and through generator electrode 228 before connecting to one pole of a power source (not shown) of which the other pole is in communication with center electrode 216, forming a closed circuit. When the oxidative switch element 238 becomes hot enough through Joule heating, an oxidation reaction will be initiated causing the resistance of the oxidative switch element to rise significantly as the conductor 222 is oxidized by the oxidizer 224. As such, flow of current through the oxidative switch element 238 will be interrupted.

The dimensions of switch element 238 should be sufficient so that when the oxidation reaction occurs, current does not continue to flow across switch element 238. In general, it can be desirable if the dimensions of switch element 238 are sufficient so that when it is in an open configuration (e.g., after the oxidation reaction has taken place) the switch element 238 can withstand at least two times the peak voltage that can be generated in the circuit when the switch opens.

When the flow of current across the oxidative switch element is interrupted, an inductive voltage spike is produced causing an arc to bridge the gap 234 (thus effectively closing the closing switch element). The arc causes current to flow from center electrode 216 to load electrode 230 and through the load (not shown). From the load, the return current passes back to the generator electrode 228 and back to the generator.

In some embodiments, the center electrode can define an access channel 236 that is in fluid communication with the gap 234. As such the gap 234 can be pressurized, or put under vacuum through the access channel 236 and then sealed depending on the voltages and/or currents required to bridge the gap 234.

Figure 6:
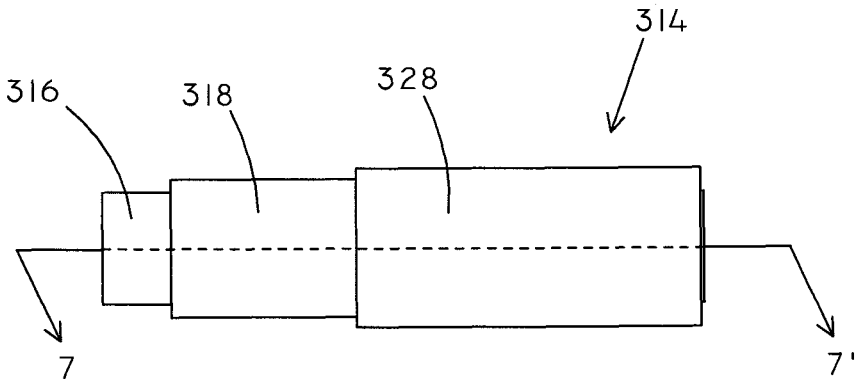
FIG. 6 is a schematic view of an oxidative opening switch assembly in accordance with another embodiment of the invention.
Figure 7:
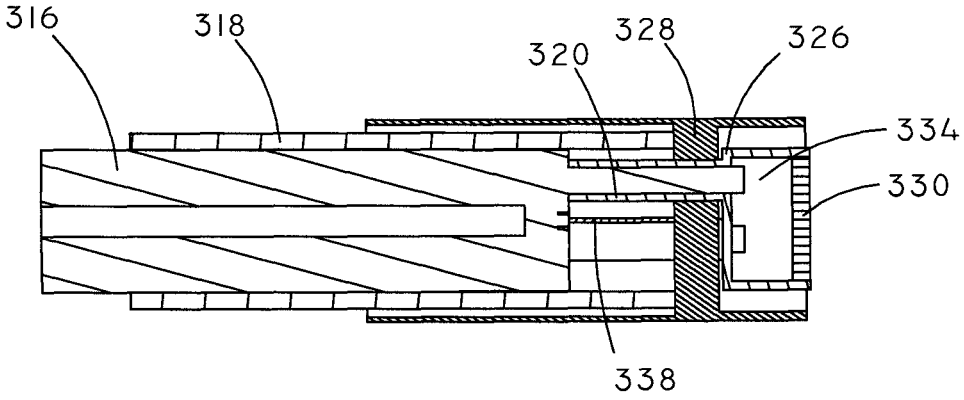
FIG. 7 is a cross-sectional view of an oxidative opening switch assembly as taken along line 7-7' of FIG. 6.

It will be appreciated that there are many different configurations possible for oxidative opening switch assemblies included herein. Referring now to FIG. 6, an oxidative opening switch assembly 314 is shown in accordance with another embodiment of the invention. FIG. 7 shows a cross-sectional view of the oxidative opening switch assembly 314 as taken along line 7-7' of FIG. 6. The oxidative opening switch assembly 314 includes center electrode 316, generator electrode 328, and load electrode 330. Initially, center electrode 316 is in electrical communication with generator electrode 328 via the oxidative switch element 338. The oxidative switch element 338 can include a conductor and an oxidizer. Initially, center electrode 316 is not in electrical communication with load electrode 330. Specifically, center electrode 316 is separated from load electrode 330 by gap 334. The oxidative opening switch assembly 314 also includes one or more insulating elements such as 318, 320 and 326.

When current initially flows through the switch assembly 314, it passes through center electrode 316, through oxidative switch element 338, and through generator electrode 328 before connecting to one pole of a power source (not shown) of which the other pole is in communication with center electrode 316, forming a closed circuit. When the oxidative switch element 338 becomes hot enough through Joule heating, an oxidation reaction will be initiated causing the resistance of the oxidative switch element to rise significantly as the conductor is oxidized by the oxidizer. As such, flow of current through the oxidative switch element 338 will be interrupted.

When the flow of current across the oxidative switch element is interrupted, an inductive voltage spike is produced causing an arc to bridge the gap 334. The arc causes current to flow from center electrode 316 to load electrode 330 and through the load (not shown). From the load, the return current passes back to the generator electrode 328 and back to the generator.

Oxidative Switch Element

Oxidative switch elements of the invention can include a conductor and an oxidizer. The conductor can include materials that can undergo an oxidation reaction in order to form a reaction product with a substantially increased electrical resistivity. By way of example the conductor can include metals, metalloids, conductive ceramics, conductive polymers, and the like. Exemplary metals can include actinide metals, lanthanide metals, alkali metals, alkaline-earth metals, and transition metals. Exemplary metals can specifically include aluminum, magnesium, titanium and zirconium. In some embodiments, the conductor of the oxidative switch element includes aluminum. It will be appreciated that the conductor can include alloys of metals.

In some embodiments, it is desirable if the conductor is a relatively good conductor of electricity prior to reaction with the oxidizer. In some embodiments, the conductor comprises a material with an electrical resistivity ($\rho$) of less than or equal to about $80\times10^{-8}$ ohm meters ($\Omega$m). It is also desirable, in some embodiments, for the electrical resistivity to change significantly after the conductor is oxidized. In some embodiments, the electrical resistivity ($\rho$) of the oxidized conductor (reaction product) is greater than about $2\times10^{4}$ ohm meters ($\Omega$m). In some embodiments, the electrical resistivity of the conductor changes by at least about one order of magnitude when the conductor is oxidized. In some embodiments, the electrical resistivity of the conductor changes by at least about two orders of magnitude when the conductor is oxidized. In some embodiments, the electrical resistivity of the conductor changes by at least about three orders of magnitude when the conductor is oxidized.

Oxidizers can include those chemical compounds that gain electrons in a redox chemical reaction. In some embodiments, oxidizers can include those compounds that readily transfer oxygen atoms. Exemplary oxidizers can specifically include sulfur hexafluoride, silicon dioxide, boric oxide, peroxide compounds, sulfoxides, nitric acid, nitrous acid, fluorine, chlorine, and bromine. However, it will be appreciated that other compounds can be used as an oxidizer.

While not intending to be bound by theory, it can be advantageous to select an oxidizer that does not evolve significant amounts of gas and does not generate a substantial amount of heat (e.g., the enthalpy change is relatively low) when reacting with the conductor. That is because the rapid generation of a significant amount of gas, or rapid temperature changes creating pressure waves could potentially lead to electrical breakdown of the evolved gases and/or structural failure of some of the elements of a switch assembly. As such, in some embodiments the oxidizer can include one or more $SiO_2$, $SF_6$, and $B_2O_3$. In particular embodiments, the oxidizer is $SiO_2$.

In some embodiments, the conductor and the oxidizer are selected so that the oxidizer will oxidize the conductor to form a reaction product with low conductivity. In some embodiments, the conductor and the oxidizer are selected so that the oxidizer will oxidize the conductor to form only solid reaction products with low conductivity.

For purposes of formulation and handling, it can be desirable for the oxidizer to be a solid or liquid at ambient conditions. In an embodiment, the oxidizer is a solid or a liquid at a pressure of 760 mm Hg and a temperature of 22 degrees Celsius.

The specific combination of a conductor and one or more oxidizers can be selected such that the oxidation reaction does not occur spontaneously in the range of normal atmospheric conditions. Generally, the conductor and oxidizer are selected so that the oxidation reaction will occur spontaneously at a temperature that is somewhere between the melt temperature and the vapor temperature of the conductor being used. In some embodiments, the conductor and the oxidizer(s) are selected so that oxidation of the oxidation reaction spontaneously occurs at a temperature of greater than about 200 degrees Celsius. In some embodiments, the conductor and the oxidizer(s) are selected so that oxidation of the oxidation reaction spontaneously occurs at a temperature of greater than about 400 degrees Celsius. In some embodiments, the conductor and the oxidizer(s) are selected so that oxidation of the oxidation reaction spontaneously occurs at a temperature of greater than about 800 degrees Celsius.

It is desirable for oxidative switch elements of the invention to be able to conduct current up to significant levels prior to undergoing oxidation to degree significant enough to cause the current to be switched, or commutated, into the load. In some embodiments, the oxidative switch element can conduct an amount of current equal to or greater than about 10 kiloamps. In some embodiments, the oxidative switch element can conduct an amount of current equal to or greater than about 100 kiloamps. In some embodiments, the oxidative switch element can conduct an amount of current equal to or greater than about 400 kiloamps.

It will be appreciated that the rate at which the conductor is chemically depleted will determine the rate at which the switch opens. This rate can be affected by many factors including the specific conductor used, the specific oxidizer used, the degree of contact between the conductor and the oxidizer, the ratio of the surface area of the conductor to the total volume of the conductor, the cross-sectional shape of the conductor, the thickness of the conductor, and the amount of current initially flowing through the conductor, amongst others.

In some applications, it is desirable for the oxidative switch element to open very rapidly. Rapid opening can decrease the rise time of the current commutated into a load. In some embodiments, the oxidative switch element can effectively open in less than about 100 μs. In some embodiments, the oxidative switch element can effectively open in less than about 10 μs. In some embodiments, the oxidative switch element can effectively open in less than about 1 μs.

In some embodiments, one or more additive agents can also be included with the oxidative switch element. For example, one or more additive agents can be combined with or disposed on the conductor. Also, one or more additive agents can be combined with or disposed on the oxidizer. By way of example, additive agents can include binders, stabilizers, coloring agents, plasticizers, fillers, dopants (either P or N type), and solvents, amongst others.

It will be appreciated that there are various techniques that can be used to construct oxidative switch elements as described herein. By way of example, in some embodiments, a conductor can be provided in an elongate form, such as in the form of a wire or a foil, and then the oxidizer can be disposed on top of the conductor, such as a coating over a substrate. In some embodiments, a solvent can be used to form a solution or mixture with the oxidizer and the resulting solution or mixture can be applied to the conductor using various techniques including spray application, dip coating, roller coating, brush coating, and the like.

In some embodiments, components of the oxidative switch element can be added together in a granular or powdered form. By way of example, in some embodiments, a granular or powdered conductor can be combined with a granular or powdered oxidizer to form an oxidative composition. This oxidative composition can then be treated in various ways in order to make it suitable for use in a desired oxidative switch element application. By way of example, in some embodiments, the oxidative composition can be sintered in order to give it desired conductive properties at a temperature below that required to initiate a rapid oxidation reaction. In some embodiments, the oxidative composition can be molded into a specific shape.

The present invention may be better understood with reference to the following examples. These examples are intended to be representative of specific embodiments of the invention, and are not intended as limiting the scope of the invention.

EXAMPLES

Example 1

Pulsed Power Circuit with Oxidative Opening Switch

Figure 8:
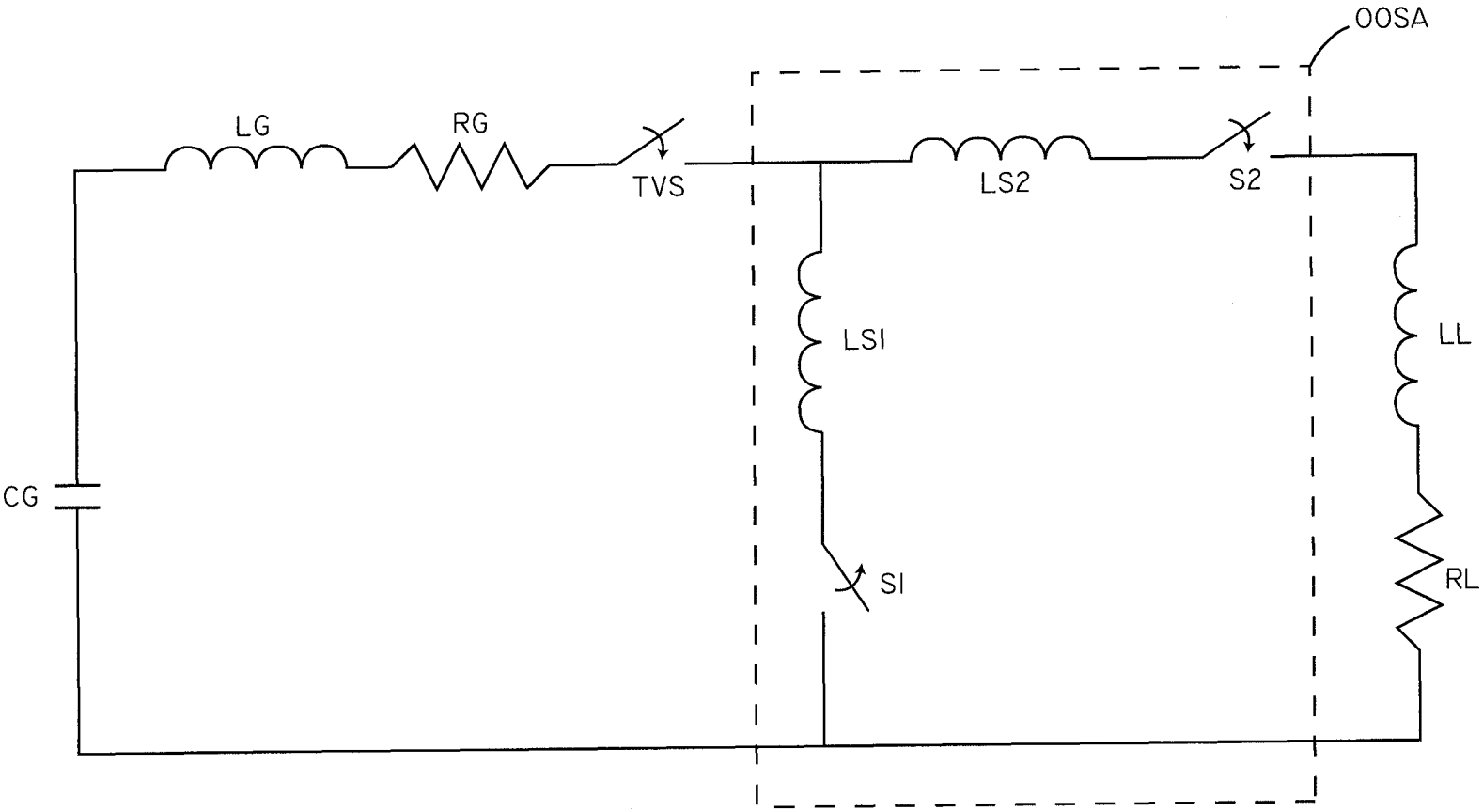
FIG. 8 is a diagram of an idealized circuit representing the pulse forming network of example 1.

An oxidative opening switch assembly was built and tested. FIG. 8 shows an idealized circuit for the pulse forming network (PFN) that was used to test the oxidative opening switch assembly. The capacitor bank (CG) consisted of four General Atomics (#3239) 204 μF, 22 kV capacitors connected in parallel to a parallel plate strip-line. The inductance of the capacitor circuit is represented by LG in FIG. 8 and the resistance of the capacitor circuit is represented by RG in FIG. 8.

The positive side of the capacitor bank strip-line was connected to a fabricated triggered vacuum flashover switch (TVS) with a nominal vacuum of $0.8\times10^{-6}$ Torr, which was then connected by a flat plate to the oxidative opening switch assembly (OOSA) configured in a coaxial manner similar to that shown in FIG. 5. Internal to the oxidative opening switch assembly OOSA were two switches: one opening switch element S1 and one closing switch element S2. The inductance of the opening switch element is represented by LS1 in FIG. 8. The inductance of the closing switch element is represented by LS2 in FIG. 8.

The opening switch element S1 was made from three conductive wires (18 gauge, 4 inches long, arranged in parallel at 120 degrees separation) inside of the cylindrical outer housing of the OOSA, that was then packed with $SiO_2$ (CAB-O-SIL®, Cabot Corporation, Boston, Mass.) to ~10% theoretical density around the aluminum wires. The other side of the opening switch element 51 was connected to the return side of the capacitor bank CG strip-line. The closing switch element S2 leg of the oxidative opening switch assembly OOSA was a fabricated center-line spark gap containing aluminum electrodes ¼ inch in diameter. The other side of the closing switch element S2 was connected to a load resistor (represented as inductor LL and resistor RL in FIG. 8) which in turn was connected to the return side of the capacitor bank CG strip-line.

The load (represented ideally as inductor LL and resistor RL in FIG. 8) consisted of a Z-folded stainless steel resistor in which each fold had a thickness of ⅛ inch and an area 4 inches on a side. The Z-fold resistor contained 24 folds. The inductance and resistance values for elements of the assembly are given in Table 1 below ($S2_{max}$ is the initial resistance of the closing switch element S2 with $S2_{min}$ being the closed resistance of the closing switch element S2).

TABLE 1

| Component | Value | Units |
|---|---|---|
| CG | 8.24E−04 | F |
| LG | 1.76E−07 | H |
| RG | 5.39E−04 | Ω |
| LS1 | 3.42E−08 | H |
| LS2 | 8.22E−08 | H |
| S2 max | 1.00E+06 | Ω |
| S2 min | 1.58E−02 | Ω |
| LL | 6.52E−08 | H |
| RL | 1.37E−08 | Ω |

Two fabricated and calibrated (with a Pearson probe) Rogowski coils with passive RC-integrators were used to measure current in the circuit. One Rogowski coil was positioned to measure the current injected into the oxidative opening switch assembly OOSA and the second Rogowski coil was positioned to measure the current commutated into the load.

Figure 9:
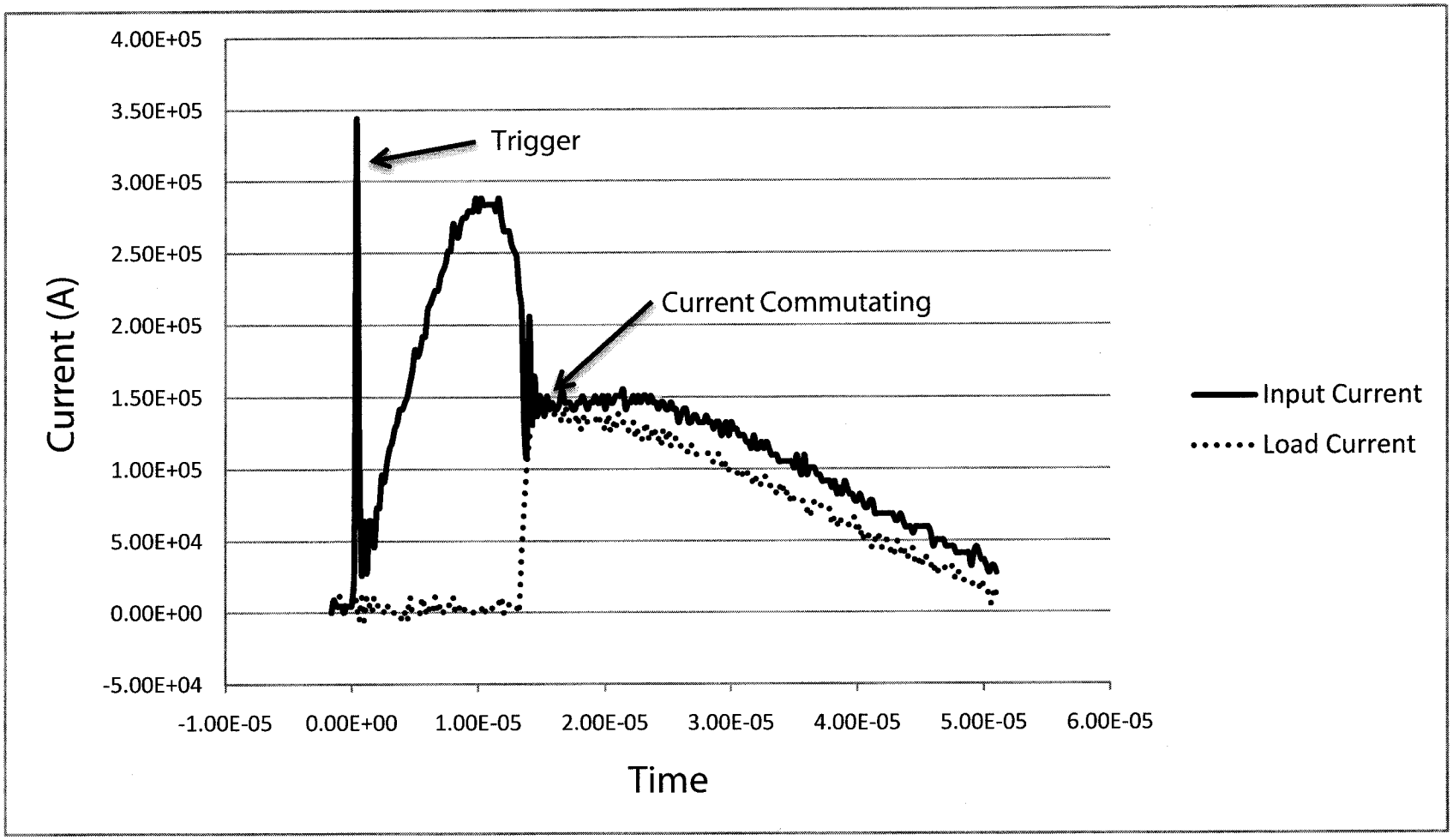
FIG. 9 is a graph of electrical current over time as measured in the pulse forming network of example 1.

The capacitor bank CG charged the generator portion of the circuit to ~7.0 kV before the TVS fired injecting current into the oxidative switch. The data generated by the Rogowski coils was captured by an oscilloscope. The digitized data for this test was downloaded and is shown in FIG. 9 with the appropriate Rogowski scaling factors used. The data show that the peak current achieved in the first segment of the circuit reached approximately 300 kA after the TVS fired and the commutation of the current occurred at about 150 kA and that the commutation time was approximately 1.1 μs.

Note that FIG. 9 shows a small difference between the current delivered to the load and the total current injected into the OOSA. A post test examination of the OOSA revealed the development of a small crack in an outer insulator leading to some current leaking through to the return current path. This insulator crack apparently occurred during the activation of the opening leg. Regardless, the test results clearly show that the switch is opening properly. Specifically, the data establish that oxidative switch successfully acted to open in response to chemical oxidation resulting in a pulse of power being delivered to the load.

The experiment was repeated wherein voltage measurements were made with a Tektronix P6015 1000:1 voltage probe that was connected to a Tektronix 2440 oscilloscope. The voltage was measured upstream of the TVS. The data from this oscilloscope showed a large voltage spike during switch opening establishing that the circuit was effective for producing a high voltage pulse.

Further trials were conducted using the same experimental setup and similar results were obtained each time suggesting that the data is reproducible.

This example shows that an oxidative opening switch assembly using selected oxidation reactions can be realized and optimized to be used in various pulsed power/prime power systems. Among the candidate systems are pulsed alternators, homo-polar generators and storage battery systems. These systems have at least an order of magnitude higher energy density than capacitive storage systems and have the potential of being developed as more compact systems than their capacitive counterparts.

Simulations performed for this test (described below in Example 2) indicate that the oxidation reactions are necessary for the effective commutation of the current in the switch.

Example 2

Simulation of Pulsed Power Circuit

Figure 10:
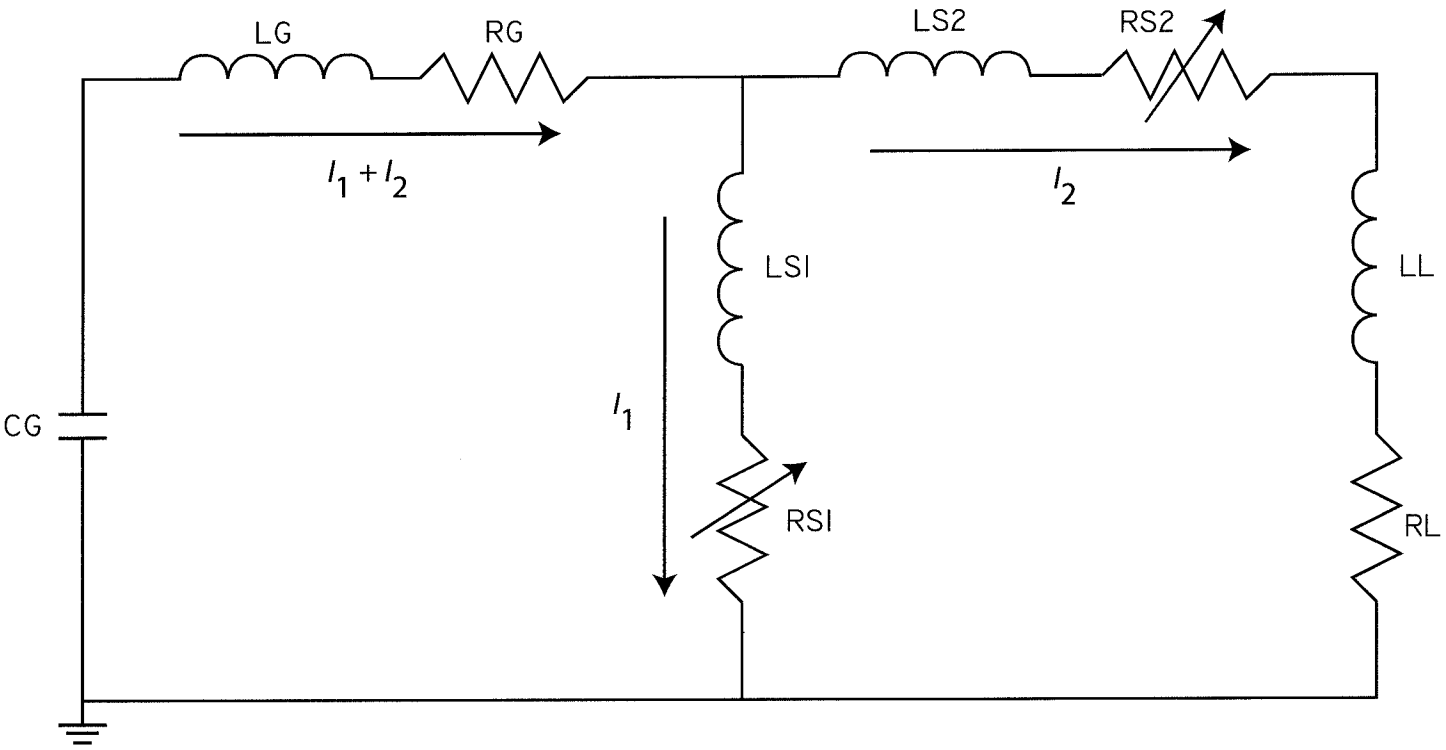
FIG. 10 is a diagram of an idealized circuit representing the simulated pulse forming network of example 2.

To further investigate the performance of the OOSA tested in Example 1, a simulation experiment was conducted wherein the opening and closing switches (S1 and S2) of the circuit in Example 1 were replaced by time dependent resistances (RS1 and RS2 respectively). The initial value of the opening switch resistor RS1 was 8.91E-04. With these changes made, and ignoring the TVS, the circuit used for the simulation is shown in FIG. 10.

With this circuit the first loop equation is given by Equation (1) below where where $L_G$ and $R_G$ are the PFN's inductance and resistance, LS1 and RS1=$R_1(t)$ are the inductance and time dependent resistance of the opening leg of the OOSA. LS2 and RS2=$R_2(t)$ are the inductance and time dependent resistance for the closing switch for leg 2 of the OOSA with LL and RL being the inductance and resistance of the load.

$$\frac{Q}{C} - L_G C - [I_1 + I_2]R_G - L_1\frac{dI_1}{dt} - I_1 R_1(t) = 0 \tag{1}$$

The time dependence of the opening switch is based on the empirical energy dependent resistance developed by Removsky et al. for Al (Removsky et al., "Inductive Store Pulse Compression System for Driving High Speed Plasma Implosions", Trans. On Plasma Science, Vol. PS-10, No. 2, June 1982). Additionally, in the opening leg there is a chemical reaction that is activated by the resistive heating of the conductive elements and can be approximated by an analogue to the chemical rate equation (Equation (2) below).

$$\frac{dA}{dt} = -kA \tag{2}$$

Where A is the cross-sectional area of the conductors and k is an effective chemical rate constant for the oxidation reaction. The cross-sectional area remains constant until a time in which the conductor reaches a threshold temperature and begins to undergo oxidation reactions. At that time the general solution for this equation is given by Equation (3) below.

$$A = A_0 e^{k(t-t1)} \tag{3}$$

For the remaining Kirchhoff equations the voltage drop along the different sections of the circuit are equal and satisfy the following Equation (4) below.

$$L_1\frac{dI_1}{dt} + I_1 R_1(t) = L_2\frac{dI_2}{dt} + I_2 R_2(t) + L_L\frac{dI_1}{dt} + I_L R_L \tag{4}$$

The total charge on the capacitors in the PFN or generator is given by Equation (5) below.

$$I_1 + I_2 = -\frac{dQ}{dt} \tag{5}$$

Equations 1, 3, 4 and 5 are solved using the Joule heating per unit mass in the opening leg of the OOSA as a threshold for the onset of the oxidation reactions. These oxidation reactions will begin at the surface of the conductors and migrate inward with the exponential behavior of equation 3 leading to significant increase in the resistance thereby producing a commutation of the current into the load.

The simulations were performed with the follow protocol:

(1) The closing switch was assumed to change from a maximum value of 1 MΩ down to 0.5 mΩ in 1 μs. The choice of switching time of 1 μs was made as there is evidence that the closing time for a 5 mm gap should be several tens of nanoseconds to less than 200 ns.

(2) The energy per unit mass threshold for oxidation reactions to occur was taken to be 7 kJ/gm. This value is in the upper portion of the vapor phase of the empirical resistive curve for aluminum (see Removsky et al).

(3) The initial set of simulations was performed without any oxidation reactions but, the results produced too low a resistance to give effective commutation of the current.

The simulation parameters were adjusted to produce the best match between the simulated load current and the actual load current as measured in Example 1 above. According to the simulation that matched the actual load data, the resistance of the opening switch resistor was greater than 10 kΩ. Table 2 below gives the results for the best match of the simulation parameters to the actual data generated in Example 1 above.

TABLE 2

| Factor | Value | Units |
|---|---|---|
| E Stored | 20.19 | kJ |
| Voltage | 7.00 | kV |
| Total Closed Inductance | 209.70 | nH |
| Total Open Inductance | 322.90 | nH |
| I1 Max | 287.90 | kA |
| I2 Max | 141.80 | kA |
| Specific E Threshold | 7.00 | kJ/gm |
| ESW2 | 4.75 | kJ |
| E Load | 4.38 | kJ |
| % Energy to Load | 45.2 | % |

Note that 45.2% of the energy is delivered to the load leg (closing switch plus load) of the circuit. The resistance of the closing switch can be reduced significantly by the use of Cu electrodes (instead of Al) and possible evacuation of the chamber containing the gap. The time to vaporization and burst with concomitant chemical reactions is independent of the length of the conductors in the opening portion of the switch but length is important for voltage withstand after burst and oxidation reactions. A shorter length conductor will reduce the inductance of that part of the circuit bearing in mind the voltage withstand requirement.

It is to be noted that the inductance of the opening switch changes from 209.7 nH to 322.9 nH in the load leg. The transition from a lower to a higher inductance during commutation leads to a longer commutation time.

This simulation establishes that an oxidation reaction between the Al and the $SiO_2$ took place in the experiment carried out in Example 1 above. This is because, as described above, the initial set of simulations was performed without any oxidation reactions but, the results produced too low a resistance to give effective commutation of the current. Therefore, since Example 1 above did provide effective commutation of current, an oxidation reaction between the aluminum conductor and the oxidizer must have taken place, instead of other mechanisms for opening the switch such as simple melting of the aluminum which would have resulted in a resistance too low to provide effective commutation.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as "arranged", "arranged and configured", "constructed and arranged", "constructed", "manufactured and arranged", and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A switch assembly comprising:

a first terminal;

a second terminal; and an oxidative opening switch element in electrical communication with the first terminal and the second terminal, the oxidative switch element comprising a conductive material and an oxidizer, the oxidative switch element configured to interrupt electrical communication between the first terminal and the second terminal as a result of an oxidation reaction between the conductive material and the oxidizer, the oxidation reaction triggered by Joule heating of the conductive material.

2. The switch assembly of claim 1, the conductive material comprising a metal.

3. The switch assembly of claim 2, the metal comprising aluminum.

4. The switch assembly of claim 1, the conductive material comprising an electrical resistivity (ρ) of less than or equal to about $80\times10^{-8}$ 8 ohm meters (Ωm).

5. The switch assembly of claim 1, wherein the oxidation reaction transforms the conductive material into a material comprising an electrical resistivity (ρ) of greater than or equal to about $2\times10^{4}$ ohm meters (Ωm).

6. The switch assembly of claim 1, the oxidizer comprising a solid or a liquid at a pressure of 760 mm Hg and a temperature of 22 degrees Celsius.

7. The switch assembly of claim 1, the oxidizer comprising a compound selected from the group consisting of $SiO_2$, $SF_6$, and $B_2O_3$.

8. The switch assembly of claim 1, the conductive material comprising a metal foil or wires, the oxidizer disposed on the metal foil or wires.

9. The switch assembly of claim 1, the oxidative switch element configured to interrupt electrical communication between the first terminal and the second terminal as a result of oxidation of the conductive material spontaneously occurring at a temperature greater than about 200 degrees Celsius.

10. A fast opening switch for pulse power applications comprising:

a pair of conductors; and an opening switch element disposed between the conductors, the switch element comprising a conductive material and an oxidizer, the conductive material configured to increase its electrical resistivity by at least an order of magnitude over a period of time no longer than about 100 milliseconds in response to an oxidation reaction triggered by Joule heating of the switch element, wherein the oxidation reaction transforms the conductive material into a material comprising an electrical resistivity (ρ) of greater than or equal to about $2\times10^{4}$ ohm meters (Ωm).

11. The fast opening switch of claim 10, the conductive material comprising a metal.

12. The fast opening switch of claim 11, the metal comprising aluminum.

13. The fast opening switch of claim 10, the conductive material comprising an electrical resistivity (ρ) of less than or equal to about $80\times10^{-8}$ 8 ohm meters (Ωm).

14. The fast opening switch of claim 10, the oxidizer comprising a solid or a liquid at a pressure of 760 mm Hg and a temperature of 22 degrees Celsius.

15. The fast opening switch of claim 10, the oxidizer comprising a compound selected from the group consisting of $SiO_2$, $SF_6$, and $B_2O_3$.

16. The fast opening switch of claim 10, the conductive material comprising a metal foil, the oxidizer disposed on the metal foil.

17. A pulse forming network comprising:

a power source;

an output load;

a closing switch in electrical communication with the output load; and an oxidative opening switch connected in parallel electrical communication with the output load; the oxidative opening switch comprising a first terminal;

a second terminal; and a switch element in electrical communication with the first terminal and the second terminal, the switch element comprising a conductive material and an oxidizer, the oxidative switch element configured to interrupt electrical communication between the first terminal and the second terminal as a result of an oxidation reaction between the conductive material and the oxidizer, the oxidation reaction triggered by Joule heating of the conductive material;

the pulse forming network configured to deliver an electrical pulse to the output load when the closing switch closes and the opening switch opens.

18. The pulse forming network of claim 17, wherein the conductive material is configured to increase its electrical resistivity by at least an order of magnitude over the quarter period of the power source.

19. The pulse forming network of claim 17, the power source comprising a device selected from the group consisting of a capacitor bank, a homopolar generator, and a battery.

20. The pulse forming network of claim 17, the closing switch comprising a spark gap switch.

21. The pulse forming network of claim 17, the closing switch comprising a vacuum spark gap switch.

* * * * *